US005333877A

United States Patent [19]

Pridgeon et al.

[11] Patent Number: 5,333,877

[45] Date of Patent: Aug. 2, 1994

[54] METHOD OF PLAYING A BOARD GAME

[76] Inventors: Jay G. Pridgeon; Patricia Green, both of 42 Nicholson Dr., Pasadena, Md. 21122; George Spector, 233 Broadway Rm 702, New York, N.Y. 10279

[21] Appl. No.: 69,216

[22] Filed: Jun. 1, 1993

[51] Int. Cl.[5] ..... A63F 3/00

[52] U.S. Cl. ..... 273/248; 273/281; 273/290

[58] Field of Search ..... 273/281, 282.3, 283, 273/284, 290, 243, 248, 249

[56] References Cited

U.S. PATENT DOCUMENTS

| | | | |
|---|---|---|---|
| 259,217 | 6/1882 | Sanderson | 273/290 |
| 1,616,328 | 2/1927 | Nix | 273/249 |
| 1,903,661 | 4/1933 | Storey | 273/248 |
| 2,743,107 | 4/1956 | Hollossy | 273/290 |
| 3,494,619 | 2/1970 | Biegonis | 273/281 |
| 3,731,934 | 5/1973 | Shoptaugh | 273/281 |
| 4,817,957 | 4/1989 | Reeves | 273/281 |
| 5,090,706 | 2/1992 | Hokanson | 273/248 |

FOREIGN PATENT DOCUMENTS

| | | | |
|---|---|---|---|
| 200704 | 3/1939 | Switzerland | 273/282.3 |
| 1413568 | 11/1975 | United Kingdom | 273/258 |

*Primary Examiner*—Benjamin H. Layno

[57] ABSTRACT

An improved board game apparatus is provided which consists of a game board having a continuous path around its perimeter divided into consecutive playing spaces of alternate colors with each of the two diagonal corner spaces being a start/home space and every corner having three additional inner playing spaces located thereby. A plurality of playing pieces are for each of the game players, with the playing pieces being of a size to fit within each of the playing spaces and are stackable one upon the other. A die operable by the game players is for determining the possible number of spaces the playing pieces shall move counterclockwise along the continuous path of the game board from the start/home space back to the start/home space.

1 Claim, 1 Drawing Sheet

METHOD OF PLAYING A BOARD GAME

BACKGROUND OF THE INVENTION

The instant invention relates generally to board games and more specifically it relates to an improved board game apparatus, which provides entertainment and pleasure for each player.

There are available various conventional board games which do not provide the novel improvements of the invention herein disclosed.

SUMMARY OF THE INVENTION

A primary object of the present invention is to provide an improved board game apparatus that will overcome the shortcomings of the prior art devices.

Another object is to provide an improved board game apparatus for entertainment and pleasure purposes for each player of the game.

An additional object is to provide an improved board game apparatus, in which the winner of the game is the first player to get all the game pieces around the game board and home safely.

A further object is to provide an improved board game apparatus that is simple and easy to use.

A still further object is to provide an improved board game apparatus that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

DETAILED DESCRIPTION OF THE PREFERRED EMBODIMENTS

Figure 1:
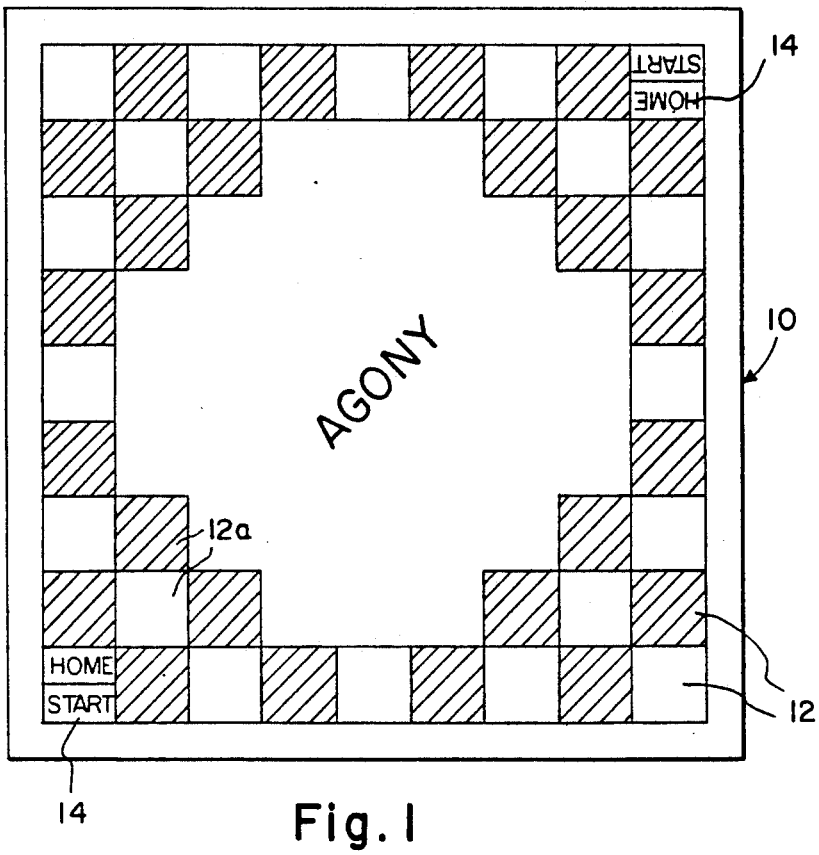
FIG. 1 is a plan view of the game board of the instant invention.
Figure 2:
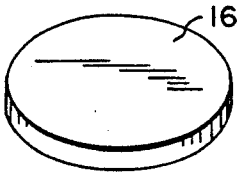
FIG. 2 is a perspective view of one of the playing pieces used in the instant invention.
Figure 3:
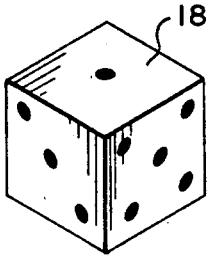
FIG. 3 is a perspective view of a die used in the instant invention.
Figure 4:
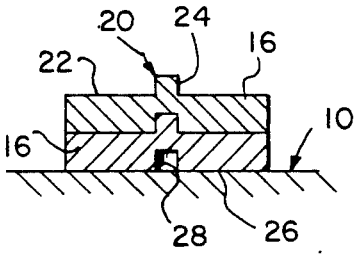
FIG. 4 is a cross sectional view taken through two stacked modified playing pieces with each having a pin and mating aperture on opposite sides.

Turning now descriptively to the drawings, in which similar reference characters denote similar elements throughout the several views, the Figures illustrate an improved board game apparatus, which consists of a game board 10, having a continuous path around its perimeter divided into consecutive playing spaces 12 of alternate colors, with each of the two diagonal corner spaces being a start/home space 14 and every corner having three additional inner playing spaces 12*a* located thereby. A plurality of playing pieces 16 are for each of the game players, with the playing pieces 16 being of a size to fit within each of the playing spaces 12 and are stackable one upon the other. A die 18 is operable by the game players for determining the possible number of spaces 12. The playing pieces 16 shall move counterclockwise along the continuous path of the game board 10 from the start/home space 14 back to the start/home space.

The improved board game 10 further includes a mechanism 20 for stabilizing the playing pieces 16, when in a stacked relationship. The stabilizing mechanism 20 includes each playing piece 16 having a first surface 22 with a pin 24 extending therefrom. Each playing piece 16 has a second opposite surface 26 with an aperture 28 extending therein. When the playing pieces 16 are stacked together during the play of the game the pins 24 will fit into the respective apertures 28, for stabilizing the stacked playing pieces 16.

Figure 5:
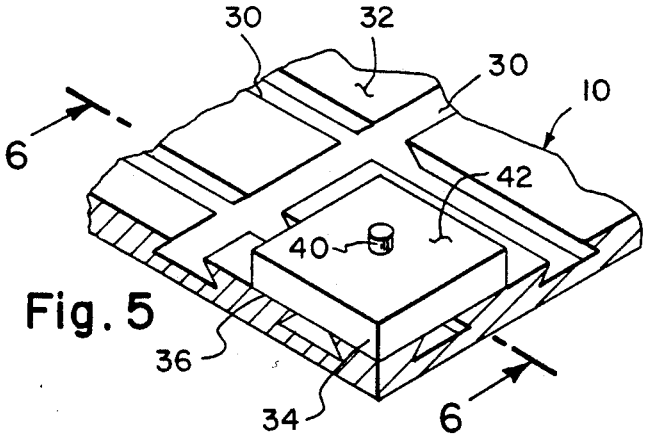
FIG. 5 is a perspective view of a portion of a modified game board, whereby the playing pieces are blocks which are adjustably positioned within tracks along the game board to vary the playing paths.
Figure 6:
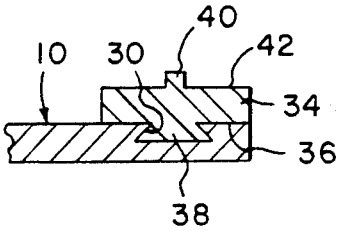
FIG. 6 is a cross sectional view taken along line 6—6 in FIG. 5.

As shown in FIGS. 5 and 6, the game board 10 has a plurality of intersecting undercut tracks 30 on its top surface 32. A plurality of adjustable blocks 34 represent playing pieces. Each block 34 has on its bottom surface 36 a follower 38 shaped to fit into and slide within the undercut tracks 30, so that the position of the block 34 can be altered in playing the game. Each adjustable block 34 further includes a pin 40 on its top surface 42, so that the pin 40 can receive an aperture 28 from one of the playing pieces 16 and also be utilized to move the follower 38 of the block 34 along the undercut tracks 30.

Rules Of The Game

1. The game requires two people as players ages 6 and up.
2. The object of the game is to be the first player to move all his playing pieces 16 around the game board 10 and take them home safely.
3. To begin the game, each player chooses a color and then places the playing pieces in front.
4. Each player then takes the die 18 and rolls, whereby the player getting the highest number goes first.
5. After deciding who goes first, that player must then roll a one or a six to start a playing piece 16.
6. If that player does not roll a one or a six a turn is lost. Then the other players alternate in turn until a one or a six is rolled.
7. After a player has rolled a one or six, the player can then start a playing piece 16 in a start space 14 to the left and then be allowed another turn. If the player then rolls another one or six another playing piece 16 can be placed on top of the one at the start space 14 or just may be moved six times.
8. Every time a one or a six is rolled a player is immediately allowed another turn. (This rule applies throughout the entire game.)
9. After starting the playing pieces 16, a player can then proceed to move them around the game board 10 counterclockwise, following the amount shown on the die 18, moving one space 12 at a time.
10. Players are not allowed to pass their own playing pieces 16 on the game board 10, but they are allowed to pass their opponents playing pieces 16.
11. Since players cannot pass their own playing pieces 16, they can stack their playing pieces 16 as high as they wish, just as long as they don't pass their playing pieces 16. They must also have the exact number shown on the die 18 to do so.

12. Players are not allowed to move backwards. The only time a player may move backwards is when stacking his playing pieces 16 or when taking the opponents playing piece 16 off the game board 10.
13. A player's playing piece 16 is taken off the game board 10 when an opponent lands on that space 12 which was already occupied. The playing piece 16 is returned back to start over, while the opponents playing piece 16 now occupies that space 12.
14. When a player's playing piece 16 or group of playing pieces are taken off the game board 10 they are returned to the start space 14 to start all over again, after they have been re-introduced into the game.
15. Anytime during the game when a three is rolled, a player may choose to exchange places. The player may exchange places with any playing piece 16 on the game board 10, including his own playing pieces 16, or he may just move three times.
16. The winner of the game is the one who gets his playing pieces 16 around the game board 10 and home safely. The home space 14 is also a start space. A player must take the playing pieces 16 home. A player cannot go back around the game board 10 to take the opponents playing piece 16 off. A player must also have the exact number as shown on the die 18 and the home space 14 cannot be occupied by any of your playing pieces 16. If the opponents playing piece 16 is on your home space 14, you go home and they must start their playing piece 16 over.
17. Players playing pieces 16 are taken off the game board 10 either forwards, backwards or diagonally. For example, if the opponent is on the same line diagonally as yours, you may move diagonally across to take him off, but you must have the correct amount shown on the die 18.
18. The game is played on the outside spaces 12 only, but a player can use the inside spaces **12*a*** when taking someone off diagonally.
19. And when rolling the die 18, it must land on the game board 10 to be considered a legal roll. If it rolls off the game board 10 it doesn't count and you roll again.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. An improved board game apparatus which comprises:

a) a game board having only one continuous path, said continuous path being rectangular in shape and formed around the perimeter of said game board, said continuous path divided into only one lane of consecutive square playing spaces of alternate colors with each of two diagonal corner spaces being a start/home space and every corner having only three additional inner square playing spaces located within said continuous path and adjacent each corner space, in every corner space, said three additional inner corner square playing spaces form two diagonal paths which bypass said respective corner space for providing direct diagonal movement of a player's piece from a space on a first side of said rectangular path to a space on a second side of said rectangular path which is perpendicular to said first side in order to take off another player's piece occupying said space on said second side while bypassing said respective corner space;

b) a plurality of playing pieces for each of the game players, with said playing pieces being of a size to fit within each of the playing spaces and are stackable one upon the other;

c) a die operable by the game players for determining the possible number of spaces, said playing pieces shall move counterclockwise along the continuous path of said game board from the start/home space back to the start/home space; further including means for stabilizing said playing pieces when in a stacked relationship; wherein said stabilizing means includes:

d) each said playing piece having a first surface with a pin extending therefrom;

e) some of said playing pieces having a second opposite surface with an aperture extending therein, so that when said playing pieces are stacked together during the play of the game, said pins will fit into said respective apertures for stabilizing said stacked playing pieces; further including f) said game board having a plurality of similarly sized intersecting undercut tracks at right angles to each other on its top surface; wherein one of said tracks is parallel to said continuous path and cuts through said playing spaces contiguous with said path; and g) wherein said playing pieces further comprise adjustable blocks having on its bottom surface a single central follower, shaped to snuggly fit into all said tracks and slide within the undercut tracks, parallel to and at right angles to said path so that the position of said block can be altered to play the game and whereby said location of said track parallel to said path is such that said blocks can be positioned to fit within each said playing space and wherein each said block further includes a pin on its surface, so that said pin can receive an aperture from one of said playing pieces and also be utilized to move the block guided by the follower along the undercut tracks.

* * * * *